US007883352B2

(12) United States Patent
Taguchi et al.

(10) Patent No.: US 7,883,352 B2
(45) Date of Patent: Feb. 8, 2011

(54) INTEGRATED CIRCUIT SOCKET

(75) Inventors: Hidenori Taguchi, Tokyo (JP); Shinichi Hashimoto, Kanagawa (JP)

(73) Assignee: Tyco Electronics Japan G. K., Kanagawa-Ken (JP)

( * ) Notice: Subject to any disclaimer, the term of this patent is extended or adjusted under 35 U.S.C. 154(b) by 152 days.

(21) Appl. No.: 12/089,995

(22) PCT Filed: Sep. 12, 2006

(86) PCT No.: PCT/JP2006/318025

§ 371 (c)(1),
(2), (4) Date: Apr. 11, 2008

(87) PCT Pub. No.: WO2007/043269

PCT Pub. Date: Apr. 19, 2007

(65) Prior Publication Data

US 2009/0280690 A1 Nov. 12, 2009

(30) Foreign Application Priority Data

Oct. 13, 2005 (JP) ..... 2005-299168

(51) Int. Cl.
*H01R 13/62* (2006.01)

(52) U.S. Cl. ..... 439/331; 439/342

(58) Field of Classification Search ..... 439/331, 439/330, 342, 73
See application file for complete search history.

(56) References Cited

U.S. PATENT DOCUMENTS 5,603,629 A * 2/1997 DeFrasne et al. ..... 439/331
6,334,786 B1 * 1/2002 Lee ..... 439/331
6,585,535 B2 * 7/2003 Murr et al. ..... 439/331
6,929,483 B2 8/2005 Huang et al.
6,971,902 B2 * 12/2005 Taylor et al. ..... 439/342
7,097,517 B2 * 8/2006 Ma ..... 439/733.1
7,160,128 B2 * 1/2007 Ma ..... 439/331
2004/0058580 A1 * 3/2004 Shirai et al. ..... 439/342
2005/0026503 A1 2/2005 Trout et al.
2006/0024987 A1 2/2006 Huang et al.

FOREIGN PATENT DOCUMENTS

JP 2005-019284 1/2005
JP 2006-49260 2/2006
JP 2006-49298 2/2006

* cited by examiner

*Primary Examiner*—Hien Vu
(74) *Attorney, Agent, or Firm*—Barley Snyder LLC

(57) ABSTRACT

An integrated circuit socket includes an insulating housing having a plurality of contact openings arranged in rows and a recess that receives an integrated circuit package. A plurality of contacts arranged in a first contact group and a second contact group in the insulating housing. Each of the contacts has a flat plate fixing member fixed in the contact opening, a connecting member extending from a lower portion of the fixing member, and a spring member extending diagonally upward from an upper portion of the fixing member. The spring member has a contact member extending into the recess. The contacts are arranged in the contact openings such that the spring members are arranged at an angle offset from a direction of arrangement of the rows and the spring arms of the first contact group are arranged in a direction opposing the spring arms of the second contact group.

5 Claims, 16 Drawing Sheets

Fig. 15 (C)
PRIOR ART
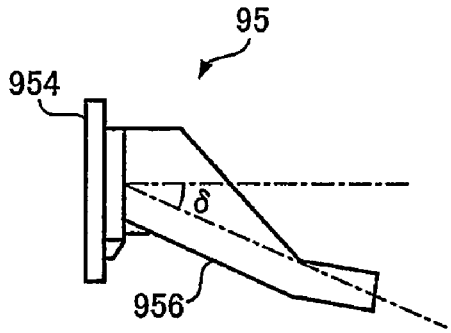
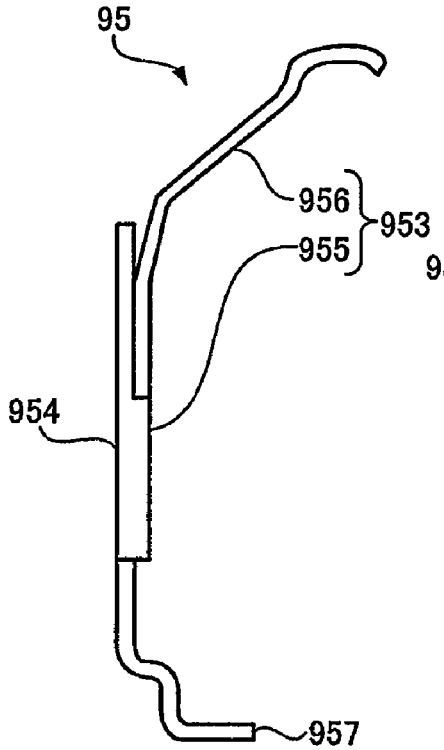
Fig. 15 (B)
PRIOR ART
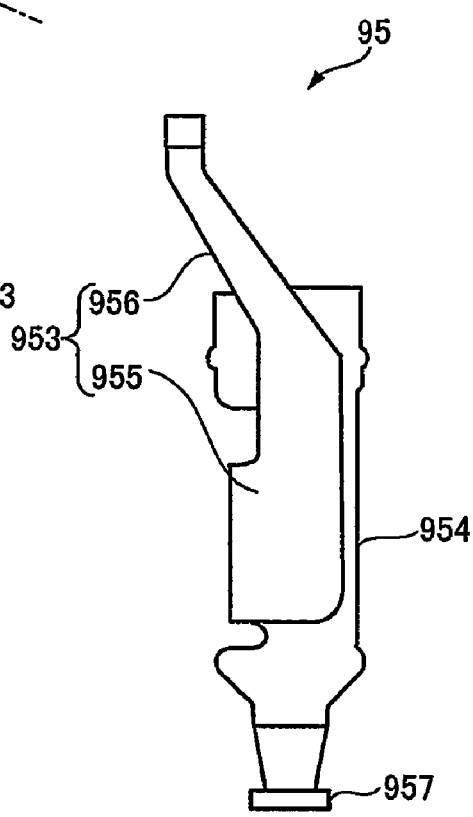
Fig. 15 (A)
PRIOR ART

INTEGRATED CIRCUIT SOCKET

CROSS-REFERENCE TO RELATED APPLICATIONS

This application claims the benefit of the filing date under 35 U.S.C. §120 of International Patent Application No. PCT/JP2006/318025 filed Sep. 12, 2006 that claims the benefit of Japanese Patent Application No. 2005-299168 filed Oct. 13, 2005.

FIELD OF THE INVENTION

The present invention relates to an integrated circuit (IC) socket for an IC package in which plural electric contact points are disposed on an undersurface thereof.

BACKGROUND

There are various types of IC packages in which semiconductor elements are packaged. For example, one type is called a land grid array (LGA) in which plate-shaped pads are disposed on an undersurface thereof and a type called a ball grid array (BGA) in which spherical pads are disposed on an undersurface thereof. When electrically connecting the IC packages of various types to wiring on circuit boards, IC sockets including contacts electrically connected to the wiring on the circuit boards are conventionally used (See Japanese Patent Laid-Open No. 2005-19284, for example).

FIGS. 14(A)-(B) are views schematically showing a part of a conventional IC socket 90 which receives an IC package 80 of a type called LGA. The IC socket 90 includes an insulating housing 91, and the insulating housing 91 is provided with a recess 915 which receives the IC package 80 from above. A plurality of contacts 95 are disposed in the recess 915 of the insulating housing 91. The contact 95 has a cantilever spring with a free end at a side of a contact point 958. The IC package 80 has a circular electric contact pad 81. Part (A) of FIG. 14 shows the state in which the IC package 80 is set in the recess 915, and part (B) of FIG. 14 shows the state in which a normal load is applied to the IC package 80 in a direction shown by the arrow by a cover (not shown).

As shown in part (A) of FIG. 14, when the IC package 80 is set in the recess 915, the contact points 958 of the contacts 95 arranged in the IC socket 90 contact electric contact pads 81 disposed on an undersurface of the IC package 80.

FIGS. 15(A)-(C) are views showing the contact 95 included in the IC socket 90 shown in FIG. 14. Part (A) of FIG. 15 shows a front view of the contact 95, part (B) shows a left side view, and part (C) shows a plan view.

The contact 95 has a base 954 which engages with the insulating housing 91 and is long in a vertical direction, and a spring member 953 which is folded back on the base 954 from a side edge of the base 954. The spring member 953 has a folded portion 955 which is folded from the side edge of the base 954, and a contact arm 956 which extends upward from the folded portion 955. The contact 95 includes a connection member 957 extending downward from the base 954. The shape of the spring member 953 is formed by the contact arm 956 extending diagonally from the folded portion 955 on the same plane as the folded portion 955 being folded at the border with the folded portion 955. Specifically, as shown in part (C) of FIG. 15, the contact arm 956 extends at an angle δ with respect to a perpendicular line of a surface of the base 954 in plane view. Thereby, when the contacts 95 are disposed in the insulating housing 91 with high density, the contact arm 956 can be kept long while avoiding the contact arm 956 contacting other adjacent contacts 95.

In the IC socket 90 which adopts the contact 95 shown in FIG. 15, when the normal load is applied to the IC package 80 in the direction shown by the arrow shown in part (B) of FIG. 14, the contact arm 956 of the contact 95 bends downward and the IC package 80 sinks down. At this time, the contact point 958 slides in a horizontal direction on a surface of the electric contact pads 81, whereby oxide films on the electric contact pad 81 and the contact 95 are scraped off, and connection is kept favorable. In the example of part (B) of FIG. 14, the contact point 958 slides in the right direction in FIG. 14.

Incidentally, when the contact point 958 slides on the electric contact pad 81, the IC package 80 receives the force which moves in the horizontal direction, as shown in part (B) of FIG. 14. When the IC package 80 receives the force in the horizontal direction, there arise the problems that the IC package 80 is prevented from sinking down, and the portion of the insulating housing 91, on which the IC package 80 is pressed, is scraped. Thus, in order to reduce the force which moves the IC package 80 in the horizontal direction by sliding movement of the contact points 958, it is conceivable to dispose a group of the contacts 95 in an orientation opposite from another group of the contacts 95, and to cancel the forces received from the contact points 958 of the respective contacts 95. However, in this case, angular momentum occurs in the direction to rotate the IC package 80 in plane view as will be described below.

FIG. 16 is a plane view showing the state in which the contact 95 included in the IC socket 90 shown in FIG. 15 bends. A solid line shows a state in which the normal load is applied, and the contact 95 bends, and a broken line shows a state in which the normal load is not applied to the contact 95. The angular momentum applied to the IC package 80 is obtained by adding up the products of the distances from a center of the IC package 80 to the contact points 958 of the respective contacts 95 and forces fi acting on the contact points 958 with respect to all the contacts 95 disposed in the IC package 80. However, in plane view, the direction in which the contact arm 956 extends has the angle δ (see part (C) of FIG. 15) with respect to the perpendicular line of the surface of the base 954, and therefore, the direction of the force fi which determines the angular momentum deviates from the direction in which the contact arm 956 extends. Specifically, the force fi includes a force fy in a direction in which the contact arm 956 extends from the folded portion 955 in plane view and a force fx in a direction perpendicular to the force fy. Here, the extent to which the direction of the force fi deviates depends on the amount by which the contact point 958 moves on the contact 95 as the contact 95 bends, and friction of the contact point 958 of each of the contacts 95 with the electric contact pad 81. Therefore, it is difficult to cancel the forces fi acting on the contact point 958 when seeing them with respect to the entire IC socket 90 and the IC package 80.

SUMMARY

In view of the above described circumstances, the present invention has an object to provide an IC socket in which forces acting on electric contact pads of an IC package are cancelled when seeing the entire IC socket and IC package.

An IC socket of the present invention which attains the above described object includes an insulating housing having a plurality of contact openings arranged in rows and a recess that receives an integrated circuit package. A plurality of contacts arranged in a first contact group and a second contact group in the insulating housing. Each of the contacts has a flat plate fixing member fixed in the contact opening, a connecting member extending from a lower portion of the fixing member, and a spring member extending diagonally upward from an upper portion of the fixing member. The spring member has a contact member extending into the recess. The contacts are arranged in the contact openings such that the spring members are arranged at an angle offset from a direction of arrangement of the rows and the spring arms of the first contact group are arranged in a direction opposing the spring arms of the second contact group.

BRIEF DESCRIPTION OF THE DRAWINGS

FIG. 15(A) is a front view of a contact of the insulating housing shown in FIG. 14(A).

FIG. 15(B) is a left side view of the contact shown in FIG. 15(A).

FIG. 15(C) is a plane view of the contact shown in FIG. 15(A).

DETAILED DESCRIPTION OF THE EMBODIMENT(S)

Figure 1:
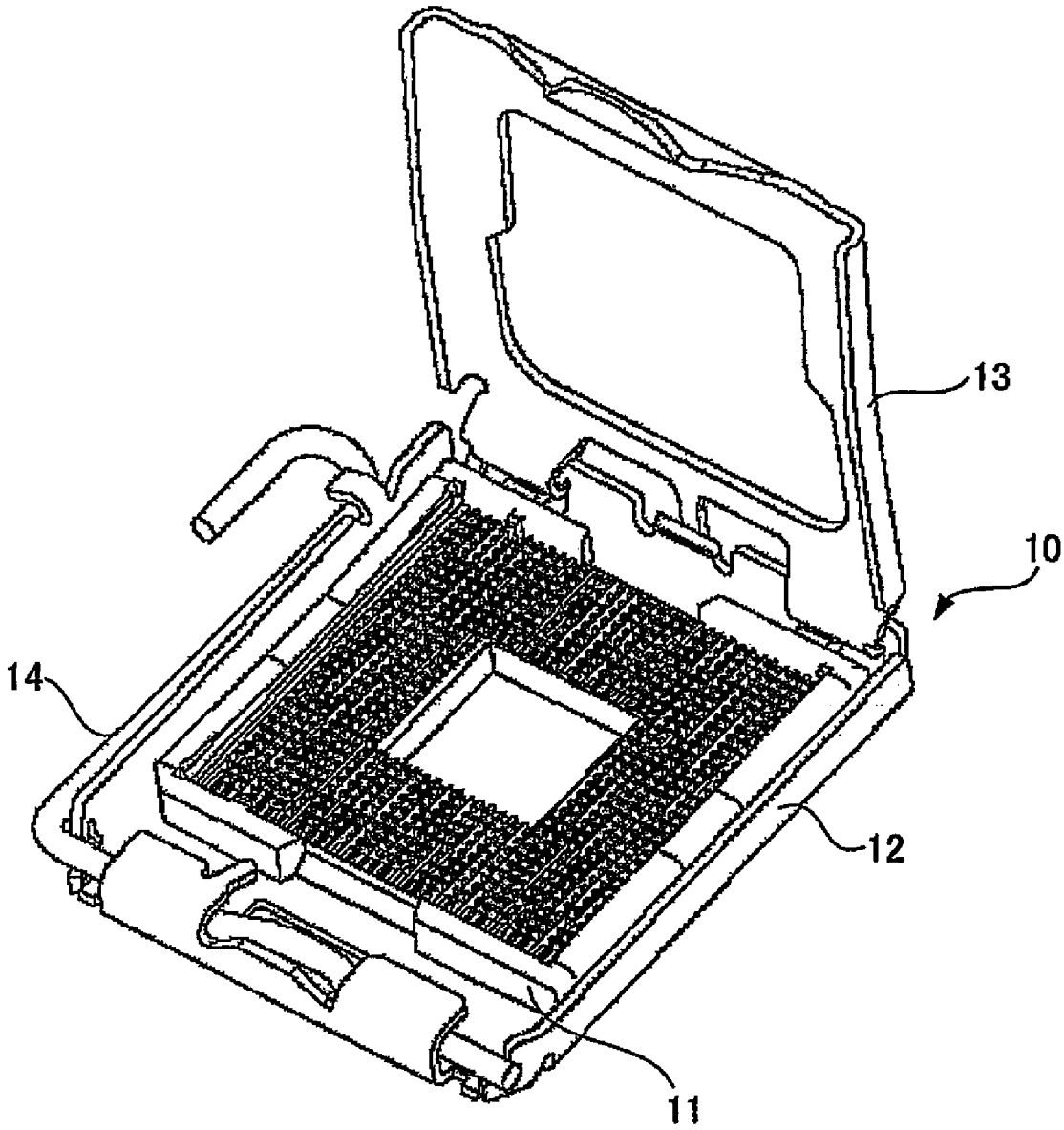
FIG. 1 is a perspective view of an IC socket according to an embodiment of the present invention showing a state in which a cover of the IC socket is open.
Figure 2:
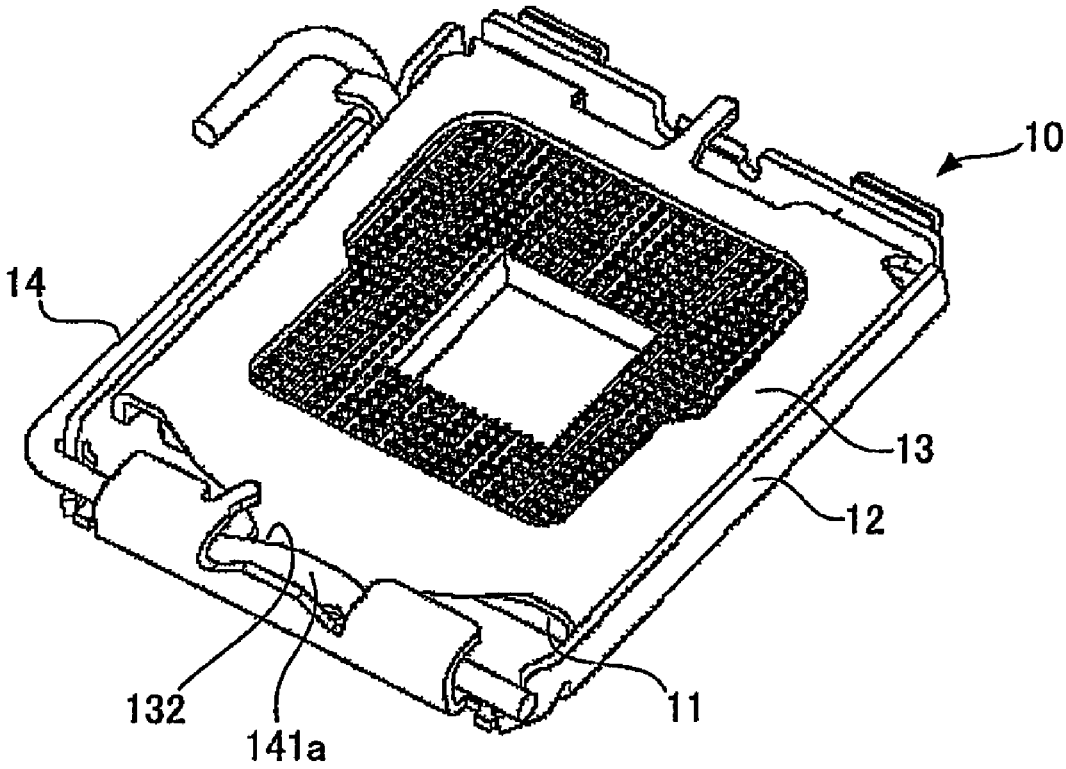
FIG. 2 is a perspective view of the IC socket shown in FIG. 1 showing a state in which the cover of the IC socket is closed.

Hereinafter, an embodiment of the present invention will be described with reference to the drawings. FIGS. 1 and 2 are perspective views showing an IC socket 10 which is one embodiment of the present invention. FIG. 1 shows a state in which a metal cover 13 of the IC socket 10 is open, and FIG. 2 shows a state in which the cover 13 is closed. The IC socket 10 shown in FIGS. 1 and 2 is a socket for receiving an IC package 50 (FIG. 3) of a type which is called an LGA in which plural electric contact pads 53 (FIG. 9) each in a circular plate shape are disposed in a matrix form on an undersurface 501 (FIG. 3) thereof. The IC socket 10 is surface-mounted on a mother board 51 (FIG. 3) loaded with, for example, central processing units (CPUs), which is placed in a personal computer or the like. The IC socket 10 has an insulating housing 11, a metal load receiving member 12, the cover 13 and a lever 14.

Figure 3:
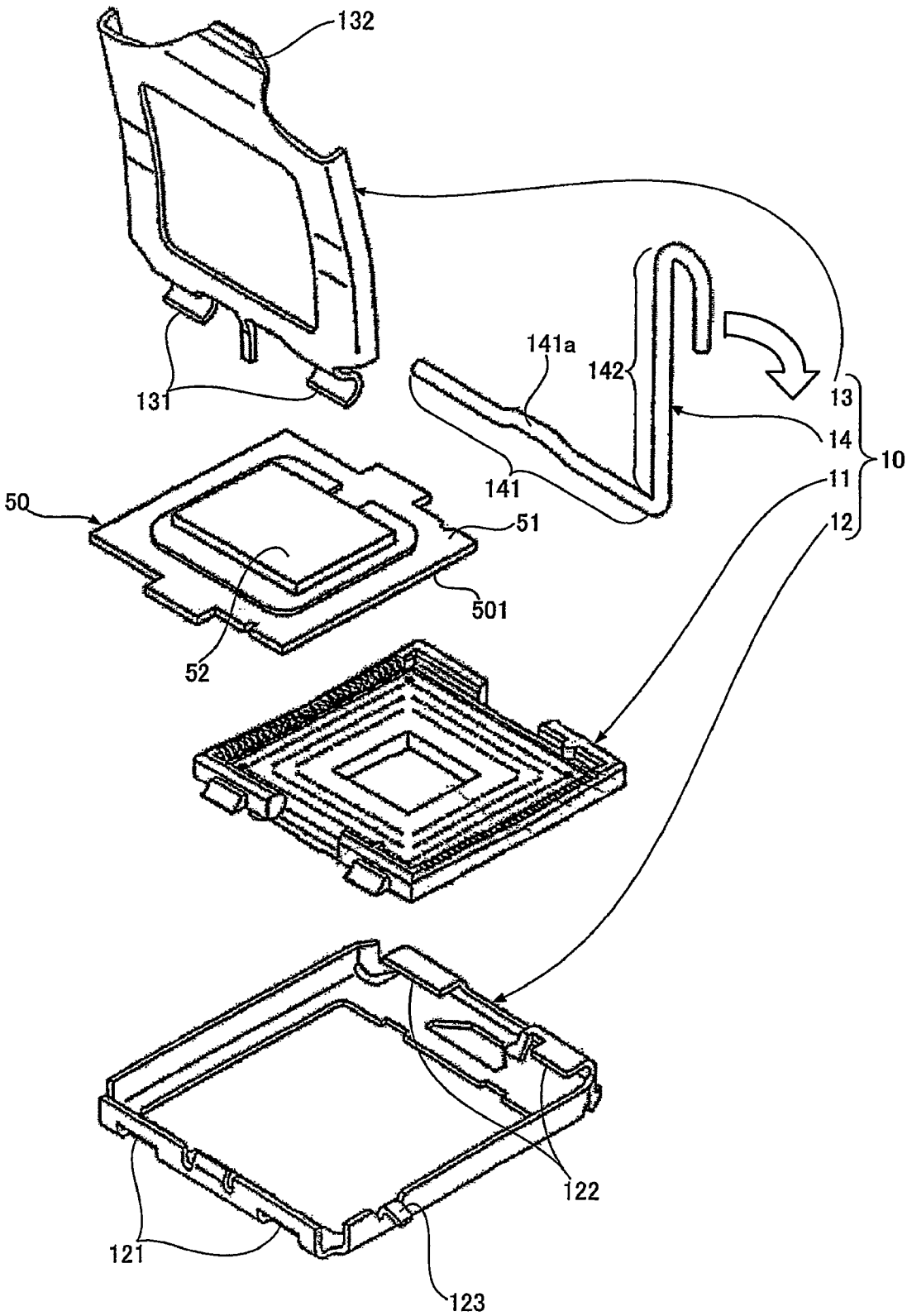
FIG. 3 is an exploded perspective view of the IC socket shown in FIG. 1 showing the IC socket with an IC package.

FIG. 3 is an exploded perspective view showing the IC socket 10 shown in FIG. 1 with the IC package 50 supported by the IC socket 10. The IC package 50 is of an LGA type, and is formed by covering a semiconductor element such as the CPU mounted on the mother board 51 of a glass epoxy resin, with a metal member 52. The lever 14 is in an L-shape including a crank 141 and an arm 142 and is illustrated in a posture in which the arm 142 is raised in FIG. 3. The cover 13 is illustrated as being open.

In the IC socket 10 shown in FIG. 3, a pair of engaging pieces 131 of the cover 13 is rotatably inserted in notches 121 at both sides of one end side (left front side in FIG. 3) of the load receiving member 12. Thereby, the cover 13 becomes openable and closable with the one end side as the rotational center with respect to the load receiving member 12. The lever 14 has the crank 141 inserted through bearings 122 at both sides of the other end side (right back side in FIG. 3) of the load receiving member 12. In the state in which the arm 142 is raised, a crank member 141*a* is also raised between the bearings 122, and the cover 13 is in an openable and closable state.

In order to fit the IC package 50 to the IC socket 10, the cover 13 is opened (see FIG. 1), the IC package 50 is set in the insulating housing 11 from above with the undersurface 501 facing the insulating housing 11. Thereafter, the cover 13 is brought into a closed state, and the arm 142 of the lever 14 is pushed down in a direction of the arrow in FIG. 3, whereby the crank member 141*a* is also pushed down. The crank member 141*a* pushes a depressing piece 132 of the cover 13 downward. Thereby, a normal load is applied to the IC package 50 which is set in the insulating housing 11. The arm 142 which is pushed down is locked to a locking member 123 of the load receiving member 12, and the normal load continues to be applied to the IC package 50. In this embodiment, the direction in which the normal load is applied by the cover 13 is described as downward, and the direction opposite to the direction in which the normal load is applied is described as upward.

Figure 4:
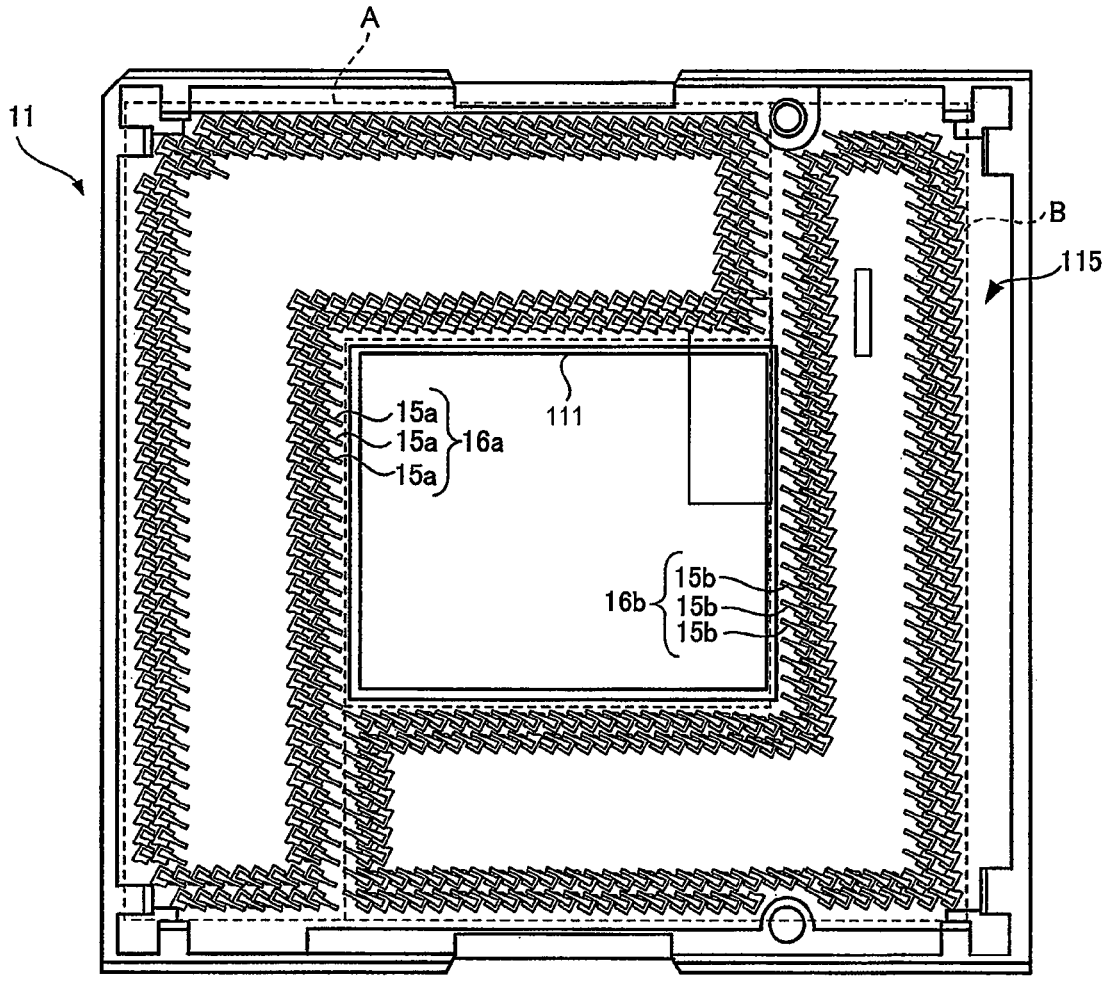
FIG. 4 is a plane view of an insulating housing of the IC socket shown in FIG. 3.

FIG. 4 is a plane view showing the insulating housing 11 of the IC socket 10 shown in FIG. 3. The insulating housing 11 is made of a resin and is provided with a recess 115 which receives the IC package 50 from above (front side of the paper surface in FIG. 4). Further, a substantially rectangular opening 111 is provided in a center of the recess 115. In the insulating housing 11, a plurality of contacts 15 (including first contacts 15*a* and second contacts 15*b*) are arranged to surround the opening 111 and are fixed. The contacts 15 include a first contact group 16*a* and a second contact group 16*b*. The first contact group 16*a* is constituted of a plurality of the first contacts 15*a* disposed in a region A shown in FIG. 4, whereas the second contact group 16*b* includes a plurality of the second contacts 15*b* disposed in a region B shown in FIG. 4. Here, the number of the first contacts 15*a* which belong to the first contact group 16*a* and the number of the second contacts 15*b* which belong to the second contact group 16*b* are preferably substantially the same. The first contacts 15*a* and the second contacts 15*b* are two-dimensionally disposed laterally and longitudinally in the regions A and B, but FIG. 4 shows only those disposed in outer peripheral portions among the first contacts 15*a* and the second contacts 15*b* disposed in the regions A and B.

Figure 5:
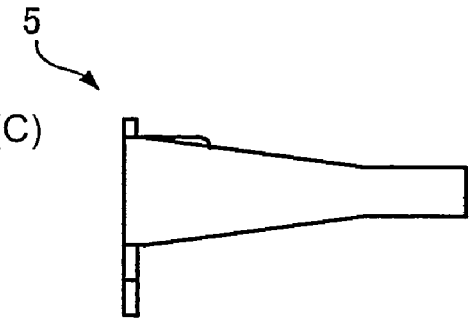
FIG. 5(A) is a front view of a contact of the insulating housing shown in FIG. 4.
FIG. 5(B) is a left side view of the contact shown in FIG. 5(A).
FIG. 5(C) is a plane view of the contact shown in FIG. 5(A).
Figure 5:
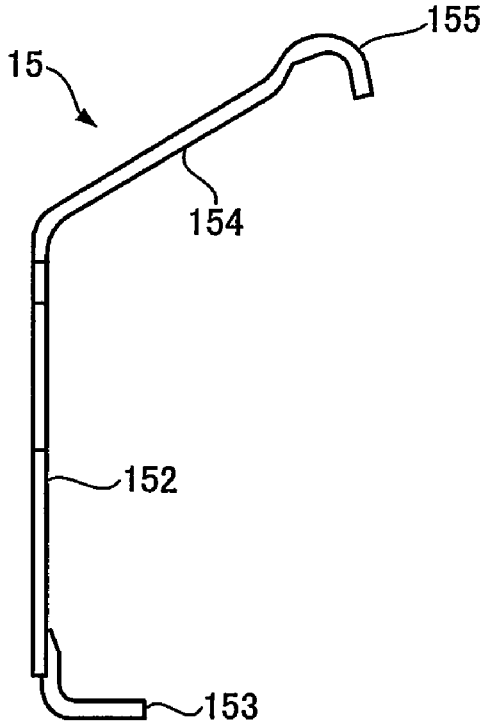
Figure 5:
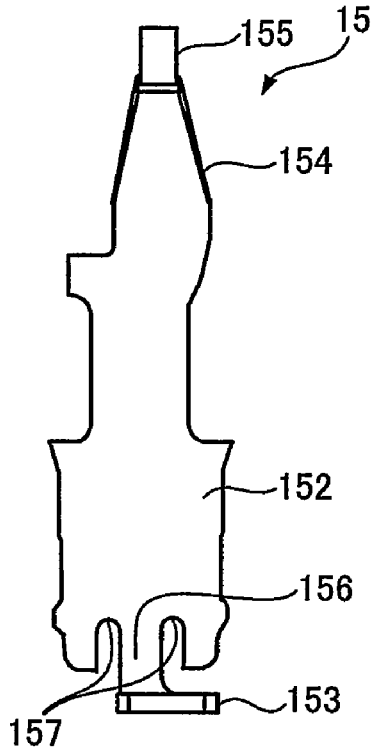

FIG. 5 is a view showing the contact 15 that is fixed to the insulating housing shown in FIG. 4. Part (A) of FIG. 5 shows a front view of the contact 15, part (B) shows a left side view, and part (C) shows a plane view. The first contact 15*a* which belongs to the first contact group 16*a* and the second contact 15*b* which belongs to the second contact group 16*b* are the same shape, and therefore, both of them will be described as the contacts 15.

The contact 15 includes a plate-shaped fixing member 152 which is fixed to the insulating housing 11, a connection member 153 formed at a portion lower than the fixing member 152, a plate-shaped spring member 154 extending diagonally upward from an upper portion of the fixing member 152, and a substantially U-shaped contact member 155 formed at an upper portion of the spring member 154. The connection member 153 performs the function of connecting the contact 15 to an electric circuit board (not shown), and solder balls 159 (FIG. 8) are welded onto an undersurface of the connection member 153. The spring member 154 supports the IC package 50 received in the insulating housing 11 from below. The contact member 155 contacts the electric contact pads 53 on the undersurface 151 of the IC package 50. Further, the contact 15 has a second spring member 156 between the fixing member 152 and the connection member 153. The second spring member 156 extends downward from a center of a lower end of the fixing member 152 and is in a plate shape smaller in width than the fixing member 152. Further, cutouts 157 are formed at both sides of the second spring member 156 of the fixing member 152. By the cutouts 157, the second spring member 156 is extended upward in such a manner as to enter an inside of the fixing member 152. Thereby, absorption of an external force by the second spring member 156 is enhanced, and the tension received by the solder balls 159 welded to the connection member 153 is reduced, while the entire length of the contact 15 is kept short.

The contact 15 may be formed, for example, by folding a punched flat plate, and the spring member 154 may be formed, for example, by folding the flat plate in the shape extending straight upward from the fixing member 152. Specifically, the spring member 154 is folded from the fixing member 152 and extends in a direction substantially perpendicular to the surface of the fixing member 152 in a plane view, as shown in part (C) of FIG. 5.

Figure 6:
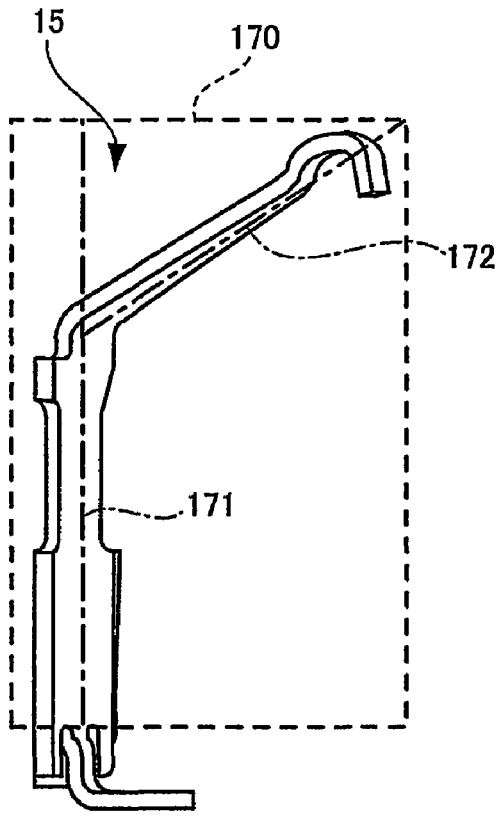
FIG. 6 is a perspective view of the contact shown in FIG. 5(A).

FIG. 6 is a perspective view showing the contact 15 shown in FIG. 5. FIG. 6 shows a perpendicular plane 170 with respect to the fixing member 152 of the contact 15, a line of intersection 171 of the perpendicular plane 170, and the fixing member 152 vertically extends through the center of the fixing member 152. Further, the perpendicular plane 170 is the same as the perpendicular plane with respect to the spring member 154, and a line of intersection 172 of the perpendicular plane 170 and the spring member 154 vertically extends through a center of the spring member 154. Specifically, as shown in FIG. 6, the spring member 154 extends in such a direction that the perpendicular plane 170 with respect to the fixing member 152 and the perpendicular plane 170 with respect to the spring member 154 become the same perpendicular plane 170.

Figure 7:
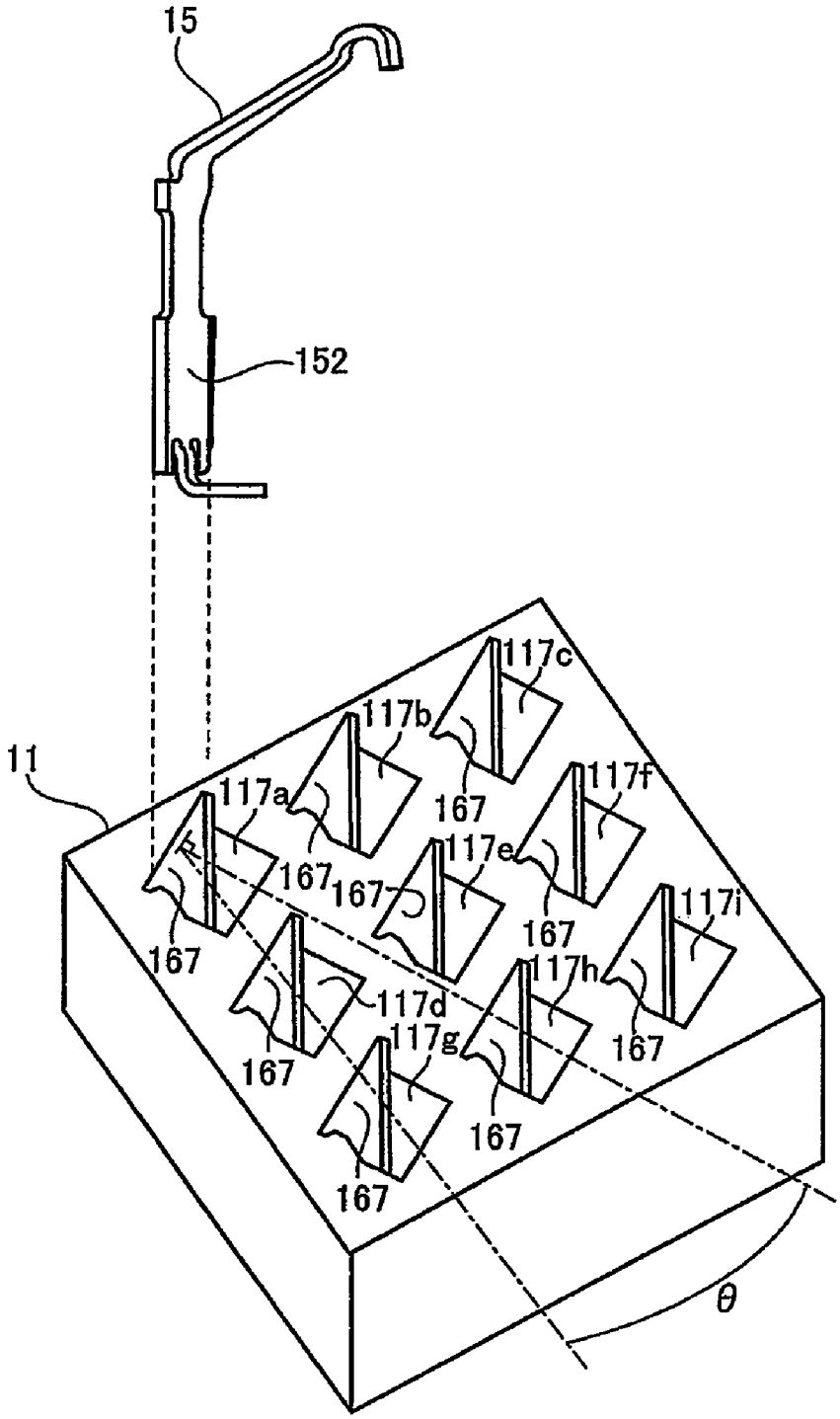
FIG. 7 is an exploded perspective view showing the contact shown in FIG. 5(A) fixed to the insulating housing shown in FIG. 4.

FIG. 7 is a perspective view showing a portion of the insulating housing 11 to which the contact 15 shown in FIG. 5 is fixed. As shown in FIG. 7, in the insulating housing 11, contact openings 117*a*, 117*b*, 117*c*, 117*d*, 117*e*, 117*f*, 117*g*, 117*h* and 117*i* are formed in a state in which they are two-dimensionally arranged laterally and longitudinally. FIG. 7 shows the portion of the insulating housing 11, in which the contact openings 117*a*, 117*b*, 117*c*, 117*d*, 117*e*, 117*f*, 117*g*, 117*h* and 117*i* are disposed in three rows and three columns. In FIG. 7, the combination of the contact openings 117*a*, 117*b* and 117*c* corresponds to one row, and the combination of the contact openings 117*a*, 117*d* and 117*g* corresponds to one column. The contacts 15 are fixed to the insulating housing 11 in the arranged state by being press-fitted into the contact openings 117*a*, 117*b*, 117*c*, 117*d*, 117*e*, 117*f*, 117*g*, 117*h* and 117*i*. Each of the contact openings 117*a*, 117*b*, 117*c*, 117*d*, 117*e*, 117*f*, 117*g*, 117*h* and 117*i* has a side wall 167 which defines an orientation of the fixing member 152 by being in surface contact with the fixing member 152. The contacts 15 are press-fitted in the contact openings 117*a*, 117*b*, 117*c*, 117*d*, 117*e*, 117*f*, 117*g*, 117*h* and 117*i* so that the fixing members 152 are in surface contact with the side walls 167.

The side wall 167 is inclined by a predetermined angle θ with respect to an arrangement direction of the contact openings 117*a*, 117*b*, 117*c*, 117*d*, 117*e*, 117*f*, 117*g*, 117*h* and 117*i*. More specifically, the side wall 167 of the contact openings 117*a*, 117*b*, 117*c*, 117*d*, 117*e*, 117*f*, 117*g*, 117*h* and 117*i* is arranged to be offset by the angle θ with respect to a row direction of the arrangement so that the contact openings 117*a*, 117*b*, 117*c*, 117*d*, 117*e*, 117*f*, 117*g*, 117*h* and 117*i*, which belong to the second adjacent row from the row to which the contact opening 117*a*, 117*b*, 117*c*, 117*d*, 117*e*, 117*f*, 117*g*, 117*h* and 117*i* belong and which belong to the column adjacent to the column to which the contact opening 117*a*, 117*b*, 117*c*, 117*d*, 117*e*, 117*f*, 117*g*, 117*h* and 117*i* belong, is located right in front of the side wall 167. For example, in FIG. 7, it is the contact opening 117*h* that belongs to the second adjacent row from the row to which the contact opening 117*a* belongs and which belongs to the column adjacent to the column to which the contact opening 117*a* belongs. The side wall 167 of the contact opening 117*a* is formed in the orientation in which the contact opening 117*h* is located right in front of the side wall 167 of the contact opening 117*a*. In this case, the angle θ of the orientation of the side wall 167 of the contact opening 117*a*, 117*b*, 117*c*, 117*d*, 117*e*, 117*f*, 117*g*, 117*h* and 117*i* with respect to the column direction of the arrangement of the contact opening 117*a*, 117*b*, 117*c*, 117*d*, 117*e*, 117*f*, 117*g*, 117*h* and 117*i* is about 26.6 degrees. Further, among plural contact openings 117*a*, 117*b*, 117*c*, 117*d*, 117*e*, 117*f*, 117*g*, 117*h* and 117*i*, the side walls 167 of the contact openings 117*a*, 117*b*, 117*c*, 117*d*, 117*e*, 117*f*, 117*g*, 117*h* and 117*i* disposed in the region A shown in FIG. 4, and the side walls 167 of the contact openings 117*a*, 117*b*, 117*c*, 117*d*, 117*e*, 117*f*, 117*g*, 117*h* and 117*i* disposed in the region B are formed to face each other.

Figure 8:
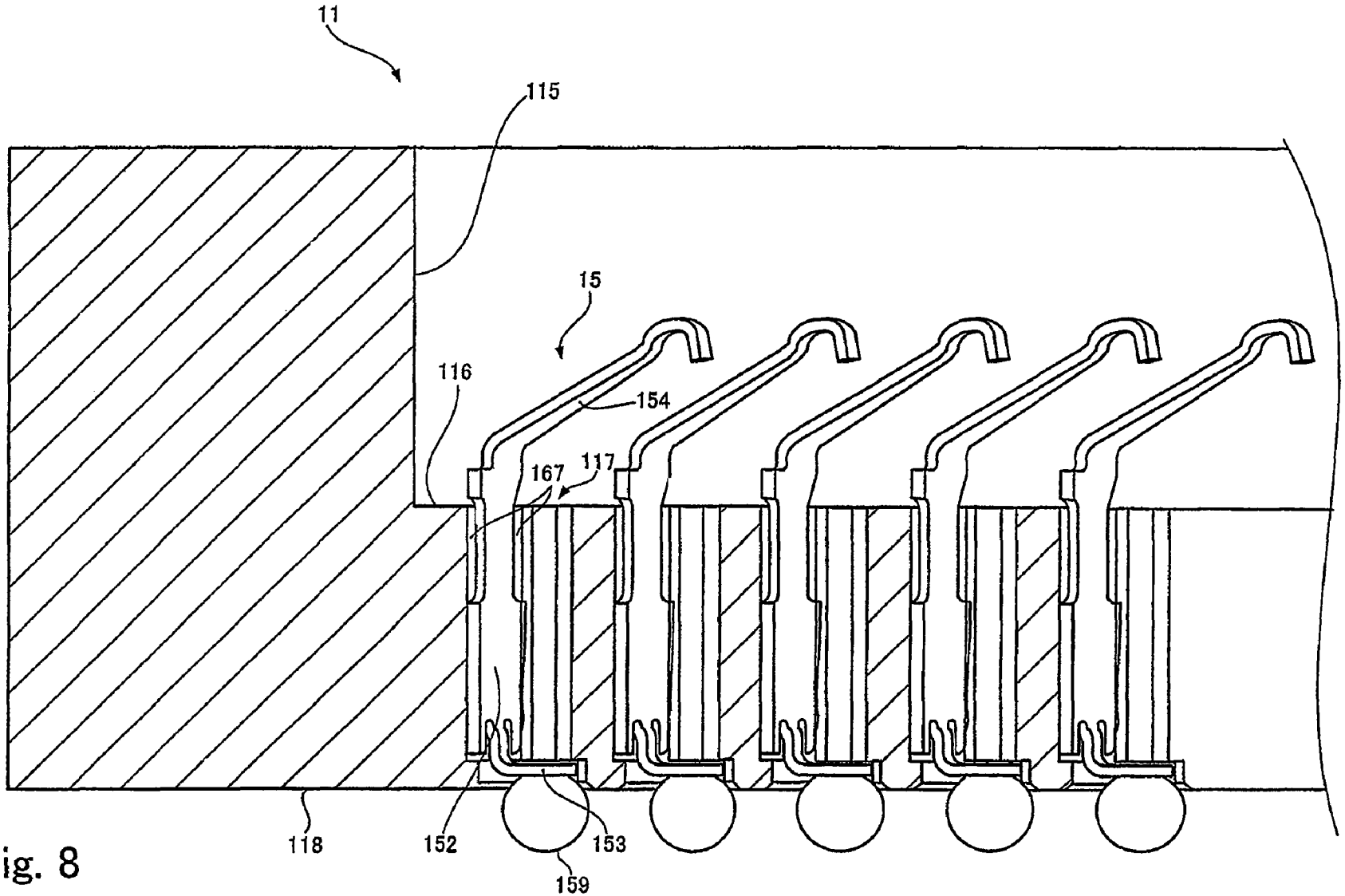
FIG. 8 is a partially sectional view showing a plurality of the contacts shown in FIG. 5(A) fixed to the insulating housing shown in FIG. 4.

FIG. 8 is a partial sectional view showing the state in which the contacts 15 shown in FIG. 5 are fixed to the insulating housing 11 shown in FIG. 4. As shown in FIG. 8, the contact openings 117*a*, 117*b*, 117*c*, 117*d*, 117*e*, 117*f*, 117*g*, 117*h* and 117*i* which are formed in a bottom surface 116 of the recess 115 of the insulating housing 11 vertically penetrate through the insulating housing 11. The contact 15 is fixed to the contact opening 117*a*, 117*b*, 117*c*, 117*d*, 117*e*, 117*f*, 117*g*, 117*h* and 117*i* so that the fixing member 152 is in surface contact with the side wall 167. The solder balls 159 are welded to the connection member 153 of the contact 15. The solder balls 159 are slightly projected from a bottom surface 118 of the insulating housing 11. The spring member 154 of the contact 15 is projected upward from the bottom surface 116 of the recess 115 of the insulating housing 11.

The orientation of the fixing member 152 of the contact 15 which is thus fixed to the contact opening 117*a*, 117*b*, 117*c*, 117*d*, 117*e*, 117*f*, 117*g*, 117*h* and 117*i* is defined by the orientation of the surface of the side wall 167. Therefore, the contact 15 is fixed in the state in which the orientation of the fixing member 152, that is, the direction in which the spring member 154 extends in plane view is inclined by the angle θ with respect to the arranging direction of the contacts 15 (FIG. 7). Thereby, the direction in which the spring member 154 of the contact 15 extends in plane view is in the orientation of the contact 15 which is in the second adjacent row and in the adjacent column from the contact 15. Therefore, the contact 15 fixed in the contact opening 117*a*, 117*b*, 117*c*, 117*d*, 117*e*, 117*f*, 117*g*, 117*h* and 117*i* can have a long spring member 154 and sufficient elastic displacement while preventing contact with the nearest contact 15 disposed in the adjacent position in the same row, or the second nearest contact 15 disposed in the adjacent row and adjacent column. Further, as shown in FIG. 4, the first contacts 15*a* which belong to the first contact group 16*a* and the second contacts 15*b* which belong to the second contact group 16*b* are disposed in the insulating housing 11 so that the spring members 154 diagonally extend in the directions opposed to one another.

Figure 9:
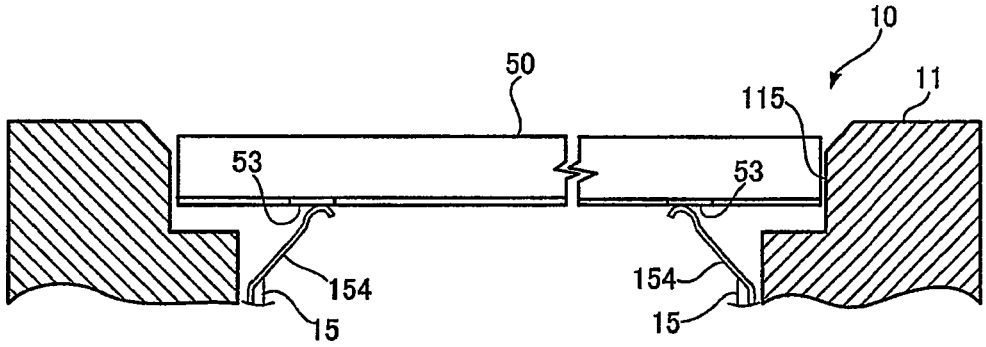
FIG. 9(A) is a partially sectional schematic view showing the IC package set in a recess of the insulating housing shown in FIG. 4.
FIG. 9(B) is a partially sectional schematic view showing the IC package set in the recess of the insulating housing shown in FIG. 4 with a normal load applied thereto by the cover.
Figure 9:
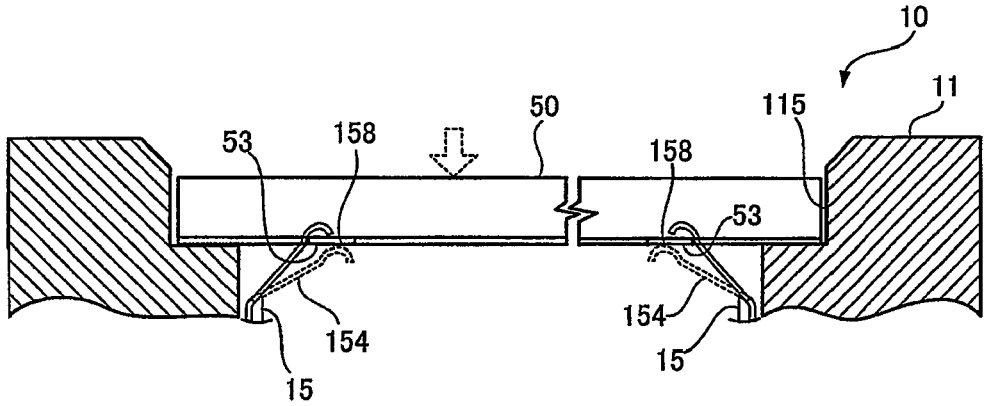
Figure 14:
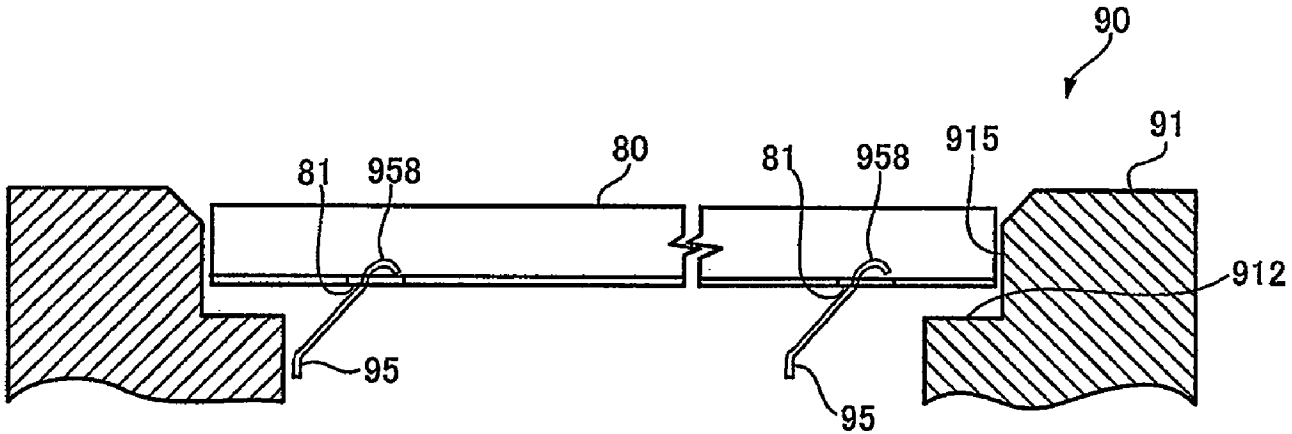
Fig. 14 (A) PRIOR ART
FIG. 14(A) is a partially sectional schematic view showing an IC package set in a recess of an insulating housing according to the prior art.
FIG. 14(B) is a partially sectional schematic view showing the IC package set in the recess of the insulating housing according to the prior art with a normal load applied thereto.
Figure 14:
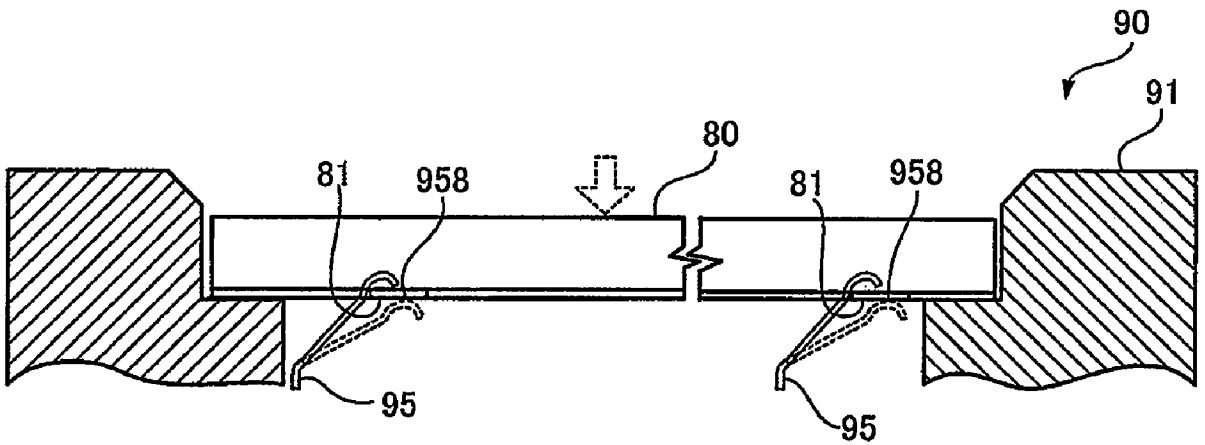
Fig. 14 (B) PRIOR ART
Figure 16:
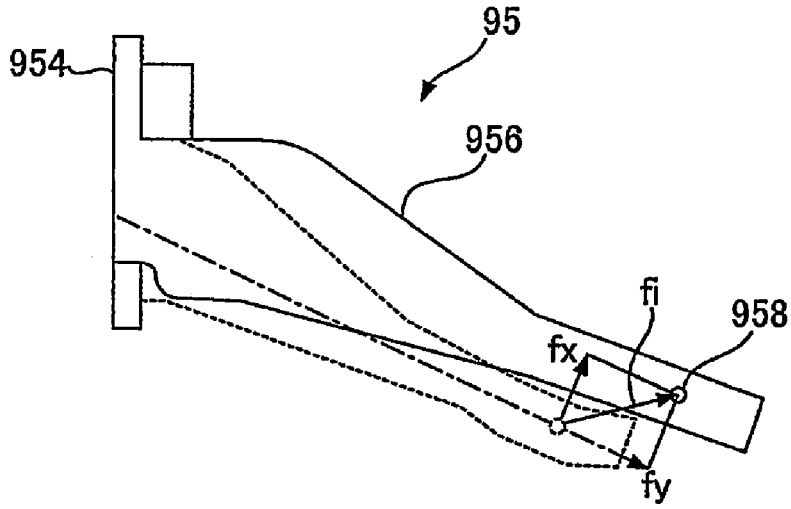
Fig. 16 PRIOR ART
FIG. 16 is a plane view of the contact shown in FIG. 15(C) in a bent state.

As shown in part (A) of FIG. 9, when the IC package 50 is set in the recess 115, a contact point 158 of the contact member 156 contacts the electric contact pad 53 disposed on the undersurface 501 of the IC package 50. When the normal load is applied to the IC package 50, the spring member 154 of the contact 15 bends downward, and the IC package 50 sinks down, as shown in part (B) of FIG. 9. At this time, the contact point 158 horizontally slides on the electric contact pad 53. The IC package 50 receives the force in a horizontal direction with the slide of the contact point 158. However, the first contact 15*a* and the second contact 15*b* are disposed so that the spring members 154 diagonally extend in the directions to face each other, and therefore, as shown in the example of part (B) of FIG. 14, the forces by the slide of the contact points 158 of the contacts 15 cancel each other. Therefore, all the forces to move the IC package 50 in the horizontal direction are cancelled to be zero.

Figure 10:
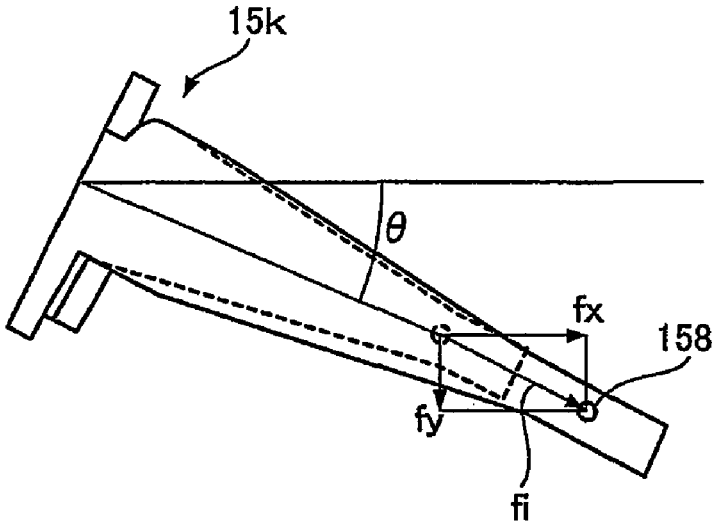
FIG. 10 is a plane view of the contact shown in FIG. 9(B) in a bent state.
Figure 11:
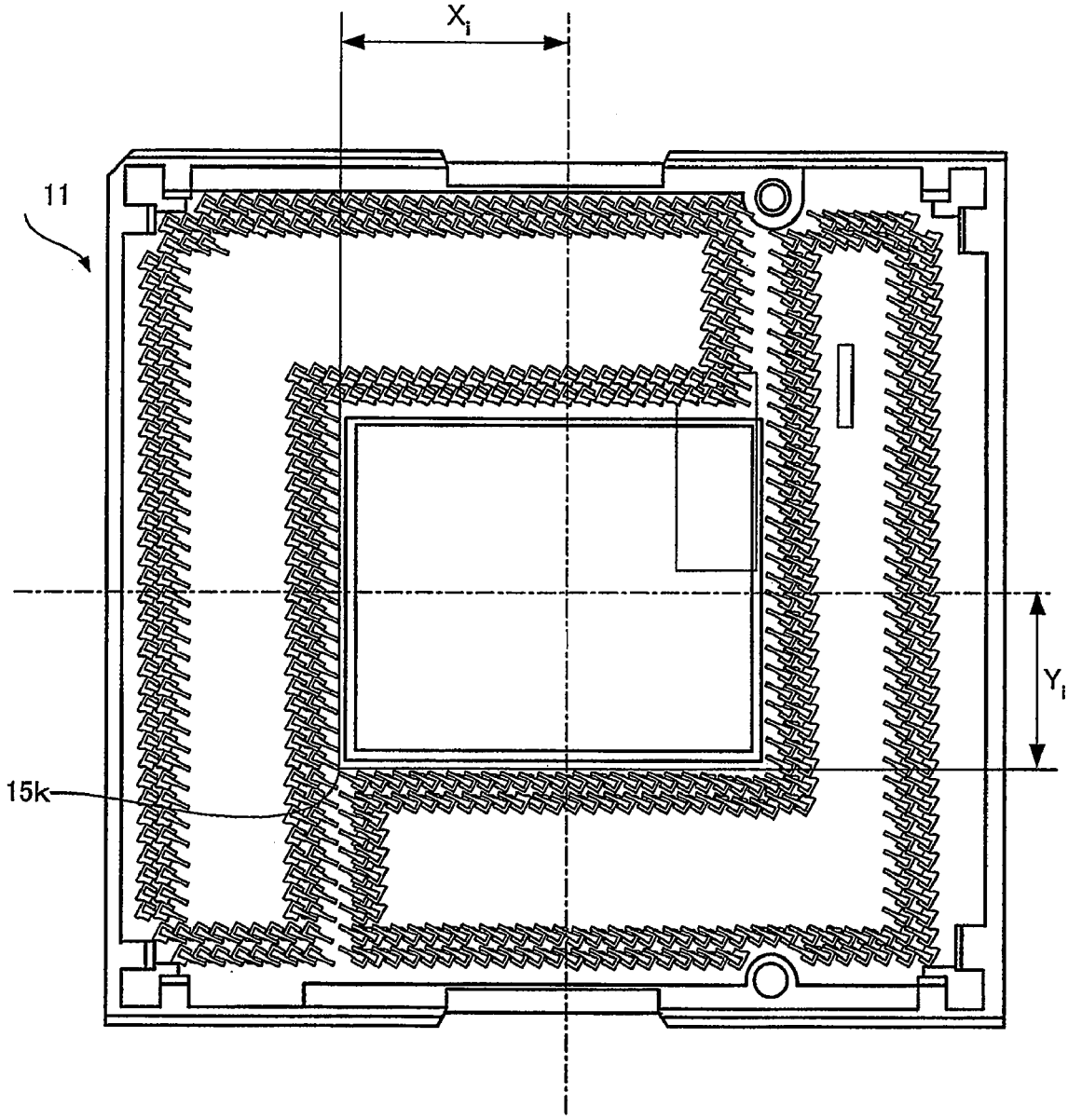
FIG. 11 is a plane view of the insulating housing of the IC socket shown in FIG. 3.

Next, the angular momentum which the IC package 50 receives as a result of the contact points 158 sliding in the horizontal direction on the electric contact pad 53 will be described. FIG. 10 is a plane view showing the state in which the contact 15 shown in FIG. 9 bends. The solid line shows the state in which the normal load is applied to the contact 15, and the contact 15 is bent, whereas the broken line shows the state in which the normal load is not applied to the contact 15. FIG. 11 is a plane view showing the insulating housing 11 of the IC socket 10 shown in FIG. 3. Here, the contact 15 shown in FIG. 10 is an arbitrary contact 15*k* of the contacts 15 disposed in the insulating housing 11 shown in FIG. 11.

The angular momentum applied to the IC package 50 by the arbitrary contact 15*k* is a product of the distance from the center of the IC package 50 to the contact point 158 of the arbitrary contact 15*k* and a force fi applied to the contact point 158. By adding up the products of all the contacts 15 of the IC package 50, the total amount of angular momentum applied to the IC package 50 is obtained. Here, the force fi by the arbitrary contact 15*k* shown in FIG. 10 is considered by resolving it into a force fx and a force fy in longitudinal and lateral directions in which the contacts 15 are arranged. Further, as shown in FIG. 11, a distance in a lateral direction from the center of the IC package 50 to the contact point 158 of the arbitrary contact 15*k* is set as Xi, and a distance in a longitudinal direction is set as Yi. When the number of the contacts 15 disposed in the IC package 50 is set as n, the total amount Mtotal of angular momentum applied to the IC package 50 is obtained from Formula 1:

$$Mtotal = \sum_{i=1}^{n} fxYi + \sum_{i=1}^{n} fyXi$$

Here, as shown in FIG. 10, the direction of the force fi which the contact 15 exerts on the IC package 50 in the horizontal direction is the same as the direction in which the spring member 154 extends. Therefore, the direction of the force fi does not depend on the amount of the movement of the contact point 158 on the contact 15 as the contact 15 bends, and the friction of the contact points 158 of each of the contacts 15 with the electric contact pads 53. Accordingly, by adjusting the angle θ in the stage of designing the IC socket 10, Mtotal can be made zero, that is, the angular momentum received by the contacts 15 can be cancelled.

As described above, according to this embodiment, the spring members 154 of the contacts 15 diagonally extend in a direction to face each other in the first contact group 16*a* and the second contact group 16*b*, and therefore, when the normal load is applied to the IC package 50 from above, the forces which move the IC package 50 in the horizontal direction can be cancelled. Further, the force fi which is given to the IC package 50 in the horizontal direction when the contact 15 bends is in the same direction as the direction in which the spring member 154 extends in plane view, and therefore, the force fi is hardly affected by the surface state of the contact point 158. Accordingly, by adjusting the angle θ at which the contact 15 is fixed in the design stage, the angular momentum which the contacts 15 apply to the IC package 50 can be cancelled. In this manner, the IC socket 10 in which the forces acting on the electric contact pads 53 are cancelled when seeing the IC socket 10 and the IC package 50 can be realized.

Figure 12:
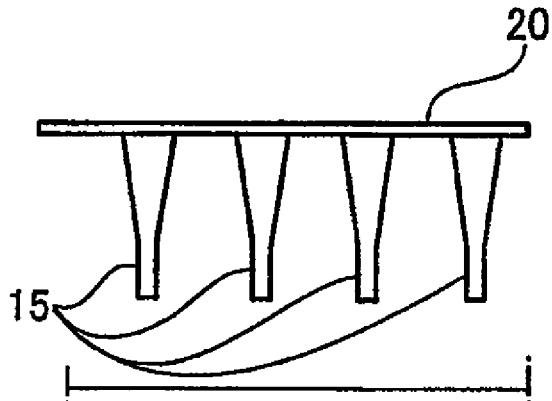
FIG. 12(A) is a front view of the contacts shown on a carrier before being mounted in the insulating housing in a manufacturing process of the IC socket.
FIG. 12(B) is a plane view of the contacts shown on the carrier shown in FIG. 12(A).
Figure 12:
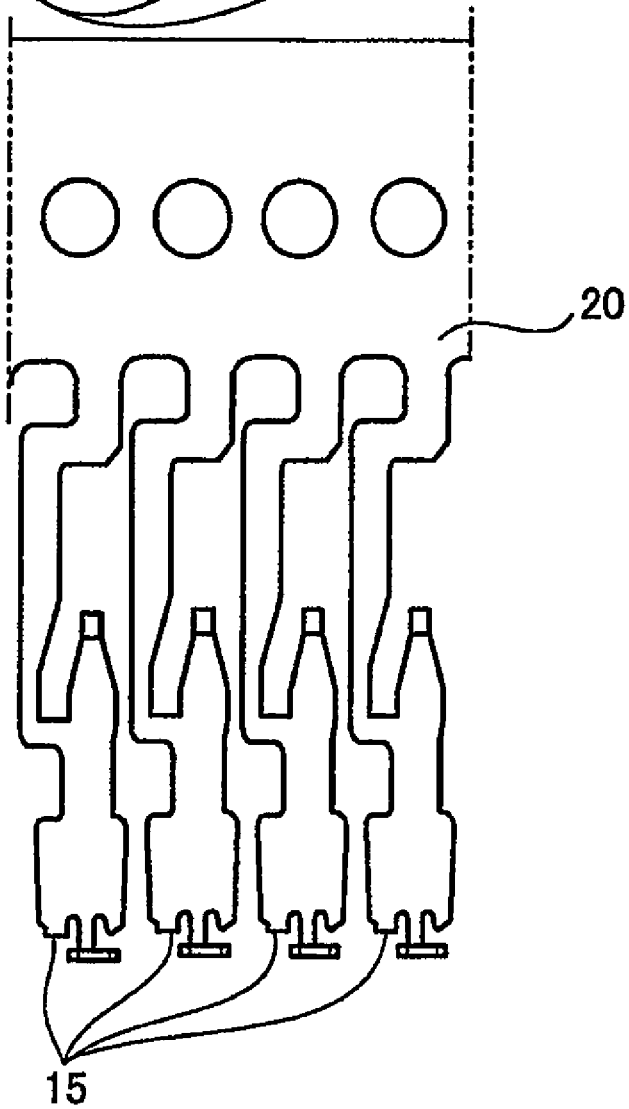

Next, mounting of the contacts 15 to the insulating housing 11 in the process of manufacturing the IC socket 10 of this embodiment will be described. FIG. 12 is an exterior view showing the contacts 15 before being mounted to the insulating housing 11 in the manufacturing process of the IC socket 10 of this embodiment. Part (A) of FIG. 12 is a front view, and part (B) is a plane view. The contact 15 is formed by punching and folding one conductive metal plate. The contacts 15 are held by a carrier 20 by being aligned in line as shown in FIG. 12. FIG. 12 shows a part of the carrier 20.

Figure 13:
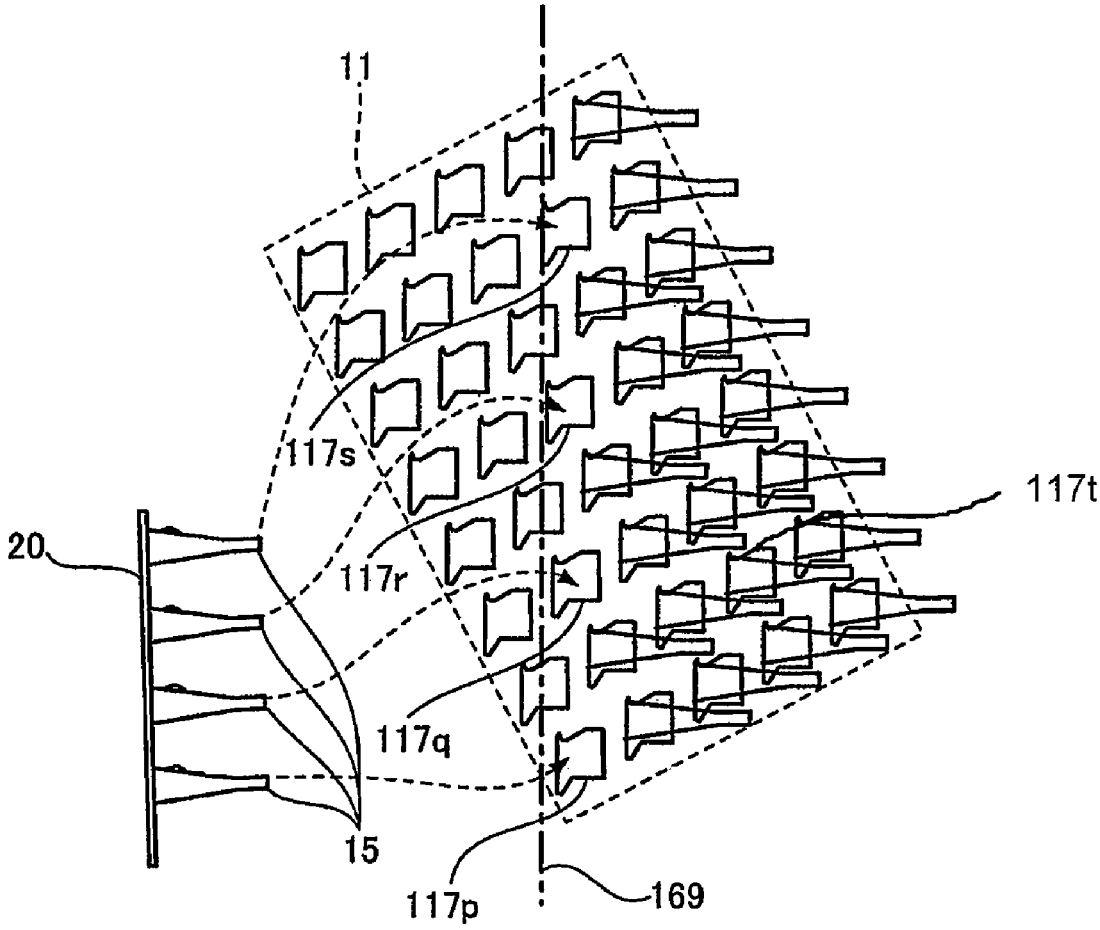
FIG. 13 is a schematic view of the contacts shown on the carrier shown in FIG. 12(A) being fixed to the insulating housing.

FIG. 13 is a schematic view showing the state in which the contacts 15 held by the carrier 20 shown in FIG. 12 are mounted to the insulating housing 11. FIG. 13 shows the insulating housing 11 in the inclined state. When the contacts 15 are onto the insulating housing 11, an automatic assembling device (not shown) is usually used. The automatic assembling device (not shown) has an inserter which inserts the contacts 15 into the contact openings 117*a*, 117*q*, 117*r* and 117*s* one by one while moving over the insulating housing 11. First, the insulating housing 11 is fixed to the automatic assembling device (not shown), and the inserter is loaded with the contacts 15 held by the carrier 20 shown in FIG. 12. Thereafter, mounting is started. The automatic assembling device (not shown) moves the inserter to a location above one of the contact openings 117*p*, 117*q*, 117*r* and 117*s* of the insulating housing 11. The inserter cuts off the contact 15 from the carrier 20 to remove it and inserts the cut contact 15 into the contact opening 117*p*, 117*q*, 117*r* and 117*s* to which the inserter is moved. Thereafter, the automatic assembling device moves the inserter to a location above another of the contact openings, and causes the inserter to insert the next one of the contacts 15 into the contact opening 117*p*, 117*q*, 117*r* and 117*s*. Subsequently, movement and insertion are repeated. Here, the contact opening 117*p*, 117*q*, 117*r* and 117*s* to which the inserter is moved to perform insertion of the contact 15 belongs to a column adjacent to the column to which the contact opening 117*p*, 117*q*, 117*r* and 117*s* for which insertion is performed immediately before this contact opening 117*p*, 117*q*, 117*r* and 117*s*, and belongs to the second adjacent row from the row to which the contact opening 117*p*, 117*q*, 117*r* and 117*s* for which insertion is performed immediately before this contact opening 117*p*, 117*q*, 117*r* and 117*s*. For example, after the inserter inserts the contact 15 into the contact opening 117*p* shown in FIG. 13, it moves to a location above the contact opening 117*q* which belongs to the adjacent column to and the second adjacent line from the contact opening 117*p*, and inserts the next one of the contacts 15 into the contact opening 117*q*. Subsequently, the inserter inserts the next of the contacts 15 into the contact opening 117*r* located in the adjacent column to and the second adjacent row from the contact opening 117*q*. Subsequently, the inserter inserts the contact 15 into the contact opening 117*s*.

As described above, the contact openings 117*p*, 117*q*, 117*r* and 117*s* of the insulating housing 11 are arranged so that the contact opening 117*t*, which belongs to the second adjacent row from the row to which the contact opening 117*q* belongs and belongs to the adjacent column to the column to which the contact opening 117*q* belongs, is located right in front of the side wall of the one contact opening 117*q*. Specifically, the contact openings 117*p*, 117*q*, 117*r* and 117*s* of the insulating housing 11 are disposed so that the side wall of the contact opening 117*p* and the side wall of the contact opening 117*q* in the column adjacent to the contact opening 117*p* and in the second adjacent row from the contact opening 117*p* are included in a common plane 169. Therefore, the inserter of the automatic assembling device (not shown) inserts the contacts in the state in which the orientation of the surface of the fixing member 152 of the contact 15 to be inserted is kept perpendicular or horizontal to the moving direction of the inserter by sequentially moving above the contact openings 117*p*, 117*q*, 117*r* and 117*s* along the common plane 169.

If the side wall of the contact opening 117*p*, 117*q*, 117*r* and 117*s* is not included in the common plane 169, the direction in which the inserter moves above the insulating housing 111 and the orientation of the surface of the fixing member 152 of the contact 15 deviate obliquely from each other. Accordingly, it is not easy to set the inserter of the automatic assembling device (not shown) to be able to insert the contacts 15 obliquely.

According to the IC socket 10 of this embodiment, when one of the contacts 15 is inserted into the contact opening 117*p*, 117*q*, 117*r* and 117*s* by the automatic assembling device in the manufacture stage of the IC socket 10, the inserter is moved along the common plane 169. Thereby, the contact 15 can be inserted in the state in which the orientation of the surface of the fixing member 152 of the contact 15 to be inserted is kept perpendicular or horizontal to the moving direction of the inserter. Thereby, setting of the automatic assembling device (not shown) which inserts the contacts 15 into the contact openings 117*p*, 117*q*, 117*r* and 117*s* can be easily performed.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An integrated circuit socket, comprising:

an insulating housing having a plurality of contact openings being two-dimensionally arranged laterally and longitudinally in a series of rows and columns and a recess that receives an integrated circuit package, the contact openings each having a side wall;

a plurality of contacts arranged in a first contact group along a first of two sides of the insulating housing and a second contact group along a second of the two sides of the insulating housing, each of the contacts having a flat plate fixing member fixed in the contact opening, a connecting member extending from a lower portion of the fixing member, and a spring member extending diagonally upward from an upper portion of the fixing member, the spring member having a contact member extending into the recess;

the contacts being arranged in the contact openings such that the spring members and side walls are arranged at an angle offset from a direction of arrangement of the rows and the spring arms of the first contact group are arranged in a direction opposing the spring arms of the second contact group; and the plurality of contacts being arranged such that at least one of the side walls faces a contact opening lying in an adjacent column and also lying in a row separated therefrom by another row;

wherein the first contact group diagonally extends in a direction different from that of the second contact group.

2. The integrated circuit socket of claim 1, wherein the spring arms of the first contact group and the spring arms of the second contact group bend toward each other when contacted by electric contact pads of the integrated circuit package.

3. The integrated circuit socket of claim 1, wherein each side wall is in surface contact with the fixing member to define the angle of orientation of the spring arms.

4. The integrated circuit socket of claim 1, wherein a plate shaped second spring member extends between the fixing member and the connection member.

5. The integrated circuit socket of claim 1, wherein the contact member is substantially U-shaped.

* * * * *